US009669428B2

(12) United States Patent
Pau et al.

(10) Patent No.: US 9,669,428 B2
(45) Date of Patent: Jun. 6, 2017

(54) PRODUCT SORTER

(71) Applicant: Pipp Mobile Storage Systems, Inc., Walker, MI (US)

(72) Inventors: Max Pau, Sammamish, WA (US); Matthew Long, Lakemoor, IL (US); R. Lee Rawl, Woodinville, WA (US)

(73) Assignee: Pipp Mobile Storage Systems, Inc., Walker, MI (US)

( * ) Notice: Subject to any disclaimer, the term of this patent is extended or adjusted under 35 U.S.C. 154(b) by 0 days.

(21) Appl. No.: 14/953,772

(22) Filed: Nov. 30, 2015

(65) Prior Publication Data

US 2016/0151807 A1 Jun. 2, 2016

Related U.S. Application Data

(60) Provisional application No. 62/086,350, filed on Dec. 2, 2014.

(51) Int. Cl.

| | |
|---|---|
| ***B07B 13/00*** | (2006.01) |
| ***B07B 13/04*** | (2006.01) |
| ***B07B 13/18*** | (2006.01) |
| ***B07B 1/46*** | (2006.01) |

(52) U.S. Cl.

CPC ..... *B07B 13/003* (2013.01); *B07B 1/469* (2013.01); *B07B 13/04* (2013.01); *B07B 13/18* (2013.01); *B07B 2201/04* (2013.01)

(58) Field of Classification Search

CPC ..... B07B 13/003; B07B 13/04; B07B 13/18; B07B 1/38; B07B 1/42

USPC ..... 20/682, 684, 659

See application file for complete search history.

(56) References Cited

U.S. PATENT DOCUMENTS

| | | | | |
|---|---|---|---|---|
| 3,744,631 | A * | 7/1973 | Smith | B07B 1/28 209/319 |
| 4,842,264 | A * | 6/1989 | Kosaka | B65H 31/24 271/176 |
| 5,325,815 | A * | 7/1994 | Gumpesberger | A01K 1/0114 119/166 |
| 5,489,017 | A * | 2/1996 | Bonnet | B65G 17/345 105/30 |
| 6,398,036 | B1 * | 6/2002 | Griebat | B07B 13/02 209/467 |
| 8,991,618 | B2 * | 3/2015 | Green | B07B 1/469 209/680 |

(Continued)

*Primary Examiner* — Terrell Matthews

(74) *Attorney, Agent, or Firm* — Gardner, Linn, Burkhart & Flory, LLP

(57) ABSTRACT

A product sorting apparatus is operable to sort products by inducing an oscillating or rocking motion to a plurality of sorting trays in a vertically stacked arrangement. A subset of the products in a top-most tray selectively pass to successive sorting trays. Each of the sorting trays is configured to receive and selectively transmit the selected products according to a separator or sorting panel that is disposed between an input and an output of a given tray. Each of the separator panels defines apertures that facilitate sorting of the products according to size and/or shape. The rocking or oscillating motion has an amplitude and a period according to an input from a drive mechanism, which may include a motor and drive link with a controller and/or a power switch. Optionally, a safety cage and one or more cutoff switches are provided for protecting the sorter and personnel.

20 Claims, 11 Drawing Sheets

(56) References Cited

U.S. PATENT DOCUMENTS

| | | | | |
|---|---|---|---|---|
| 2005/0183980 | A1* | 8/2005 | Fernandez | B65D 21/043 206/509 |
| 2016/0096653 | A1* | 4/2016 | Stratton | B65D 11/12 414/332 |
| 2016/0151807 | A1* | 6/2016 | Pau | B07B 13/003 209/682 |
| 2016/0255874 | A1* | 9/2016 | Murphy | A23P 30/10 |

* cited by examiner

PRODUCT SORTER

CROSS REFERENCE TO RELATED APPLICATION

The current application claims the benefit of U.S. provisional application Ser. No. 62/086,350, filed Dec. 2, 2014, which is hereby incorporated herein by reference in its entirety.

FIELD OF THE INVENTION

The present invention relates to product sorting apparatuses for retail and commercial applications.

BACKGROUND OF THE INVENTION

Retail stores commonly use reusable security tags attached to products such as clothing or other fabric goods, luggage, and the like, to discourage or prevent theft of the goods from a retail store or other area. Product security tags often have main bodies of different shapes and dimensions ranging from circular to square or rectangular, wide or narrow, and with pins or protrusions extending in different directions from the main body. The size, shape, and type of tags used on the goods will vary based on many factors, such as the type and value of the goods, and the particular retailer's security policy. However, many security tags include a main body portion with a pin having a sharp point that penetrates the fabric goods and is received in a second tag portion. Such tags are typically deactivated and/or removed from the goods at a purchase counter by a retail associate and stored in a bin or other storage receptacle for future use on other goods. Typically the tags of various types are mixed in a single bin at the purchase counter or point-of-sale, but because only one type of tag is used for a particular type of product, it is desirable to sort the tags by type upon removing them from the bin. Sorting the tags, such as by type and size, is usually done manually by retail associates, which requires a significant amount of labor that is further slowed when the tags include sharp points that pose an injury risk.

SUMMARY OF THE INVENTION

The present invention provides a product sorting apparatus that is particularly well suited for sorting products having different shapes and sizes, such as product security tags that are commonly used on clothing and other goods in a retail setting. The product sorting apparatus sorts products by imparting an oscillating or rocking motion to a plurality of sorting trays in a vertically stacked arrangement. The sorting apparatus uses trays having different sizes, shapes, and orientations of apertures or slots to pass only a subset of products from one tray to the next, so that substantially one type or subset of a mixture of products will be retained in each tray at the end of a sorting cycle.

According to one form of the present invention, a product sorter includes a frame, a powered drive mechanism, and a plurality of sorting trays with dividers for separating products according to size and/or shape. The powered drive mechanism and the sorting trays are coupled to the frame, with the sorting trays in a vertically stacked arrangement and operatively coupled to the drive mechanism. Each sorting tray has an input at an upper end and an output at a lower end, with a divider positioned between the input and output. Each divider defines at least a portion of an opening that is sized and shaped to permit passage of at least one type of product among a group of products that can include multiple different types. The drive mechanism is operable to drive the sorting trays in an oscillating movement, such as a rocking motion in which the trays pivot about respective pivot axes.

Optionally, sorting trays include a first tray and a second tray positioned directly below the first tray, with the first and second trays configured so that when the trays are in a first position (e.g., non-tilted), the second tray is entirely below the first tray, and when the trays are in a second position (e.g., tilted), at least a portion of the second tray is located above at least a portion of said first tray.

Thus, it will be appreciated that the product sorting apparatus can be made vertically compact with the individual sorting trays somewhat nested together so that multiple trays can be stacked vertically while remaining accessible to an operator, typically without use of a ladder, which facilitates sorting many different types of products simultaneously in an easy-to-use device. The product sorting apparatus sorts products with a drive mechanism that imparts an oscillating or rocking motion to a plurality of sorting trays in a stacked arrangement. The sorting apparatus reduces the labor required to sort many types of products, such as security tags for retail clothing, and can improve safety by reducing the manual handling of such tags, which could have sharp points that can pose a risk of injury.

These and other objects, advantages, purposes and features of this invention will become apparent upon review of the following specification in conjunction with the drawings.

DESCRIPTION OF THE PREFERRED EMBODIMENTS

Figure 1:
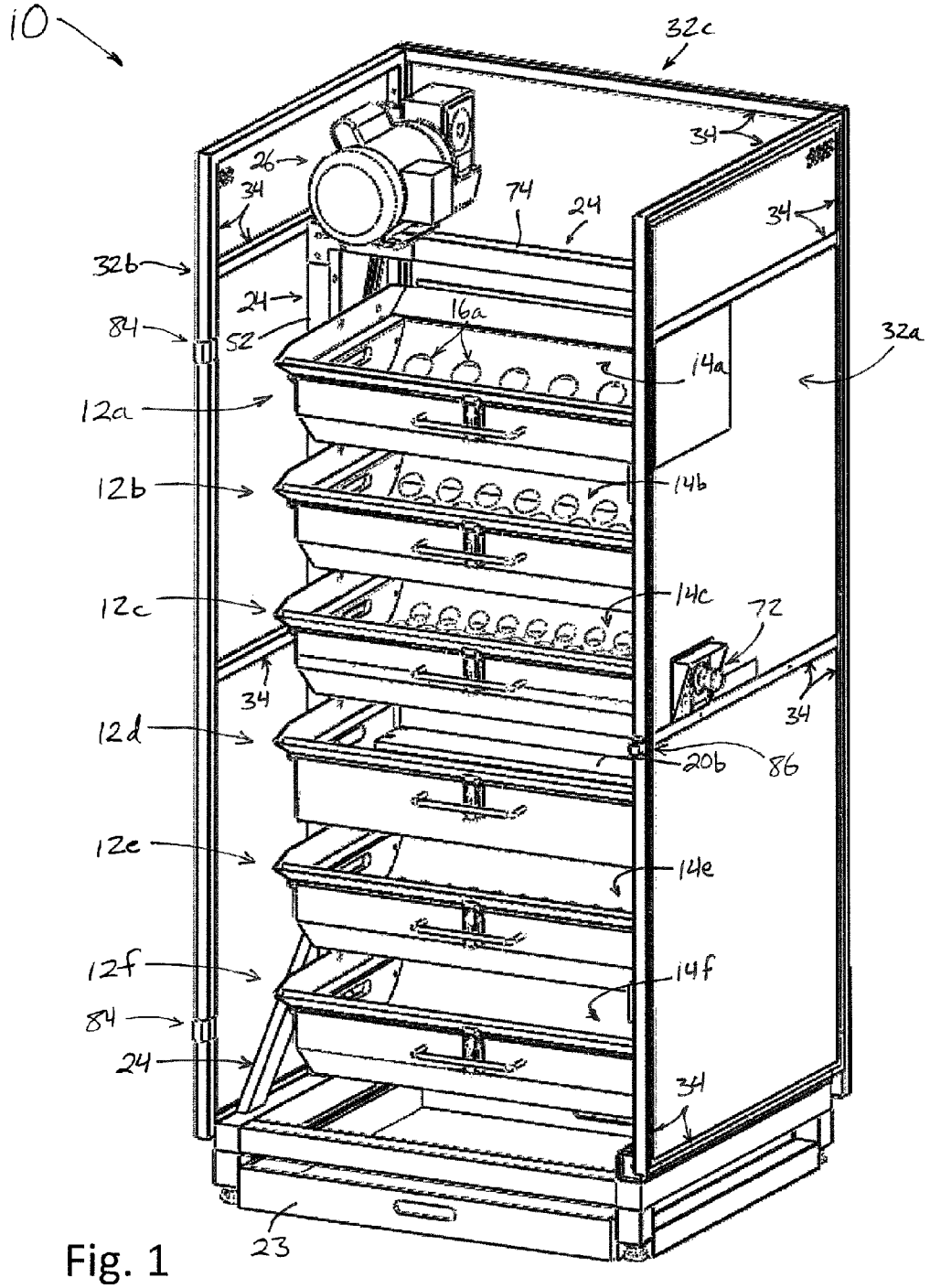
FIG. 1 is a front perspective view of a product sorter in accordance with the present invention, in which a front access door has been removed to show internal structure.

Referring now to the drawings and illustrative embodiments depicted therein, a product sorting apparatus 10 is operable to sort products with minimal handling and labor by a user. Sorting apparatus or sorter 10 uses a rocking or oscillating motion imparted to a plurality of sorting trays 12*a-f*, so that products can selectively pass to successive sorting trays. In the illustrated embodiment, a top-most sorting tray 12*a* can receive a mixture of different types of products, which are then sorted into one or more of the successive sorting trays 12*b-f*, such as shown in FIGS. 1-3, 5, 19 and 20. The rocking or oscillating motion generally has an amplitude and a period that causes the products to follow a substantially random motion within each of sorting trays 12*a-f*.

In the illustrated embodiment, a first subset of the sorting trays 12*a*, 12*b*, 12*c*, 12*e* have respective concave-up bottom panels or separator panels 14*a*, 14*b*, 14*c*, 14*e* that each define a plurality of openings or apertures 16 through which a certain subset of products will pass. Optionally, another sorting tray 12*d* includes a separator in the form of a substantially planar bottom panel 18 and a pair of elevated panels 20*a*, 20*b* at opposite sides thereof (FIGS. 7-9), and defining an elongate slot 22 between bottom panel 18 and each of the elevated panels 20*a*, 20*b*. Typically, the bottom-most sorting tray 12*f* has a bottom panel 14*f* that is devoid of apertures so as to retain all products that have passed through the sorting trays 12*a-e* above it, although it will be appreciated that small openings or apertures or slots may be provided so as to permit any small debris to separate from the products and fall into a slide-out debris tray 23 at the bottom of sorter 10. The product sorting apparatus 10 further includes a structural frame 24 that supports the trays 12*a-f*, a powered drive mechanism including an electric motor 26 and a linkage 28 for connecting the motor 26 to the sorting trays 12*a-f*, and a controller 30 for activating and de-activating the motor 26, and a safety structure that includes a cage or screen 32 mounted to an outer support frame 34.

Figure 2:
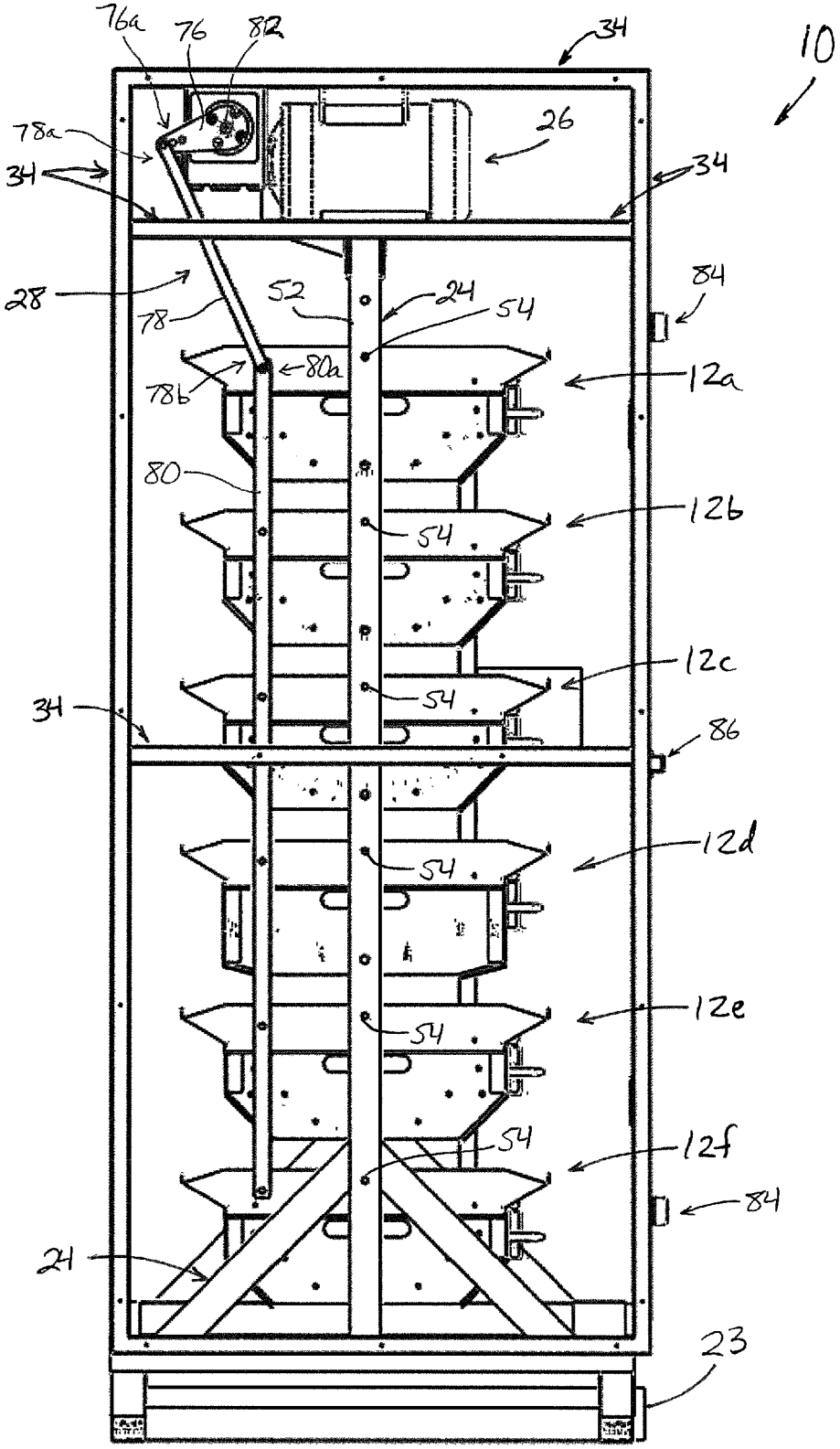
FIG. 2 is a right side elevation of the product sorter of FIG. 1, with its door and safety cage removed to show structure.
Figure 3:
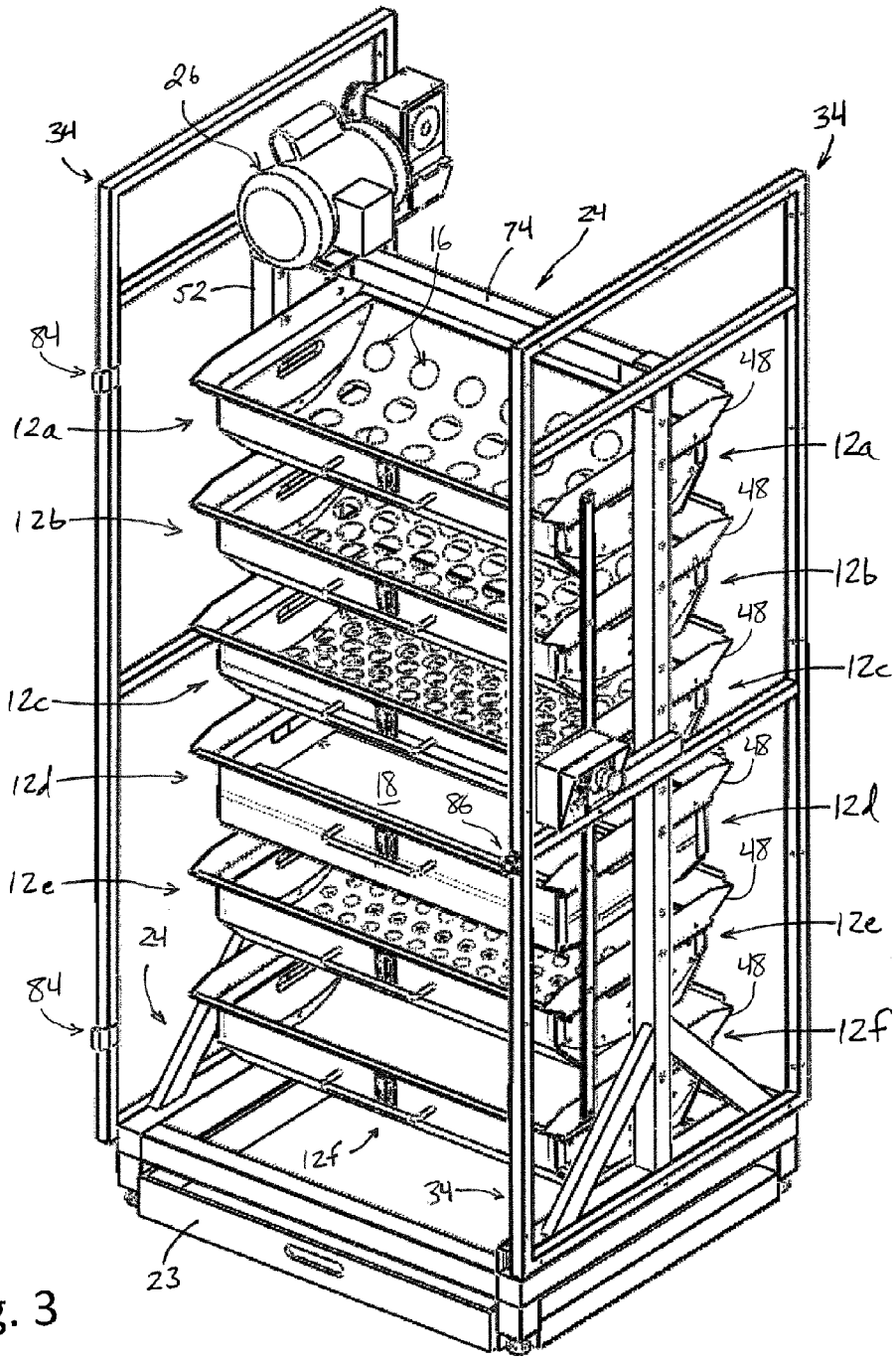
FIG. 3 is a front perspective view of the product sorter of FIG. 2.
Figure 4:
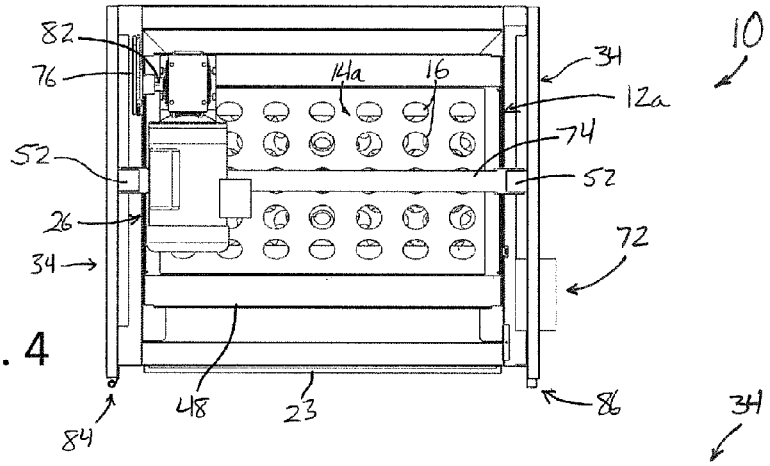
FIG. 4 is a top plan view of the product sorter of FIG. 1.
Figure 5:
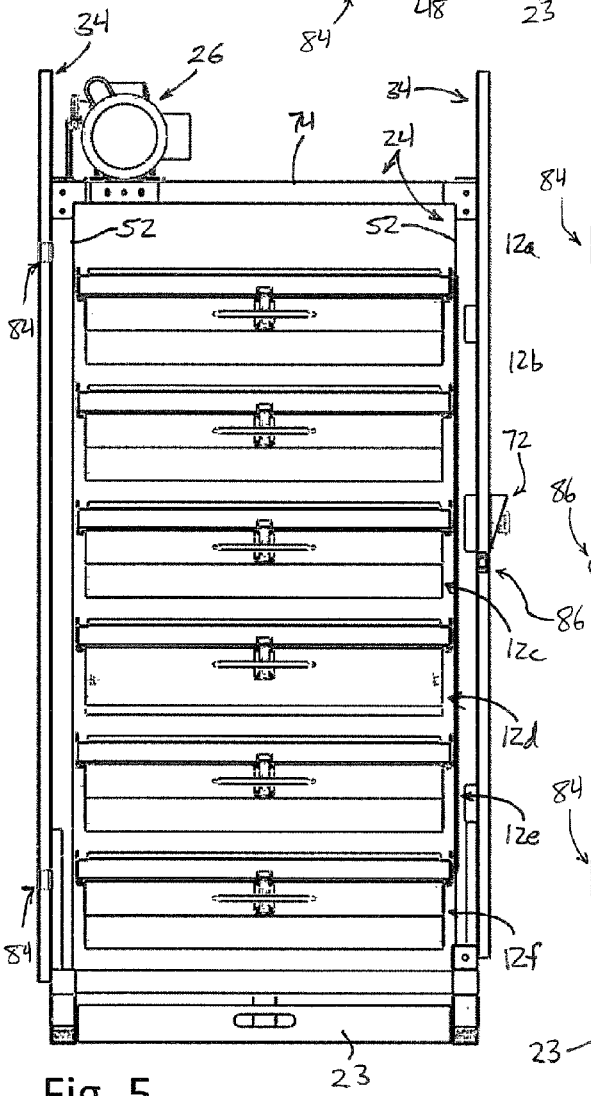
FIG. 5 is a front elevation of the product sorter of FIG. 2.
Figure 6:
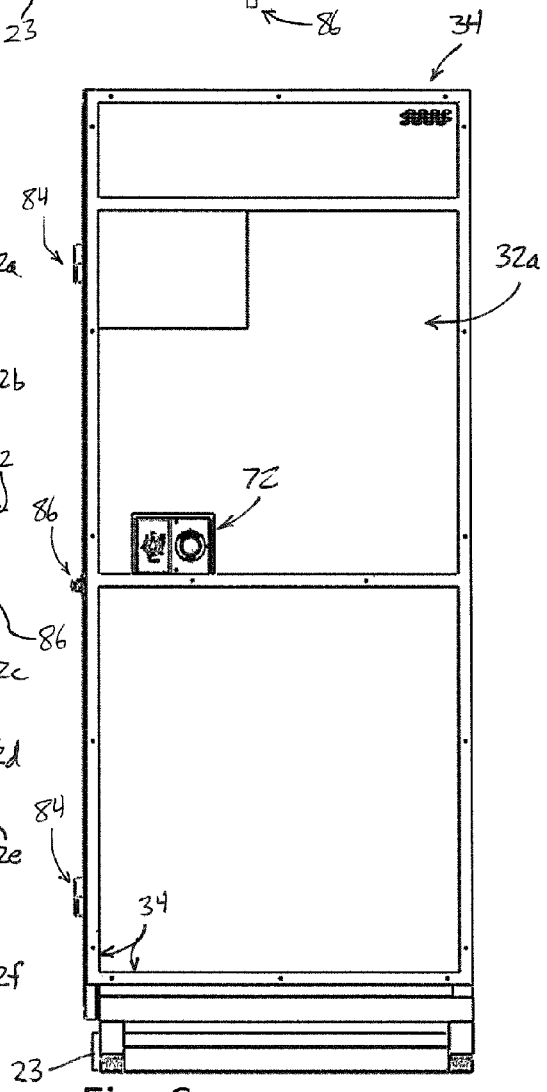
FIG. 6 is a left side elevation of the product sorter of FIG. 2.

Sorting trays 12*a-f* are arranged in stacked vertical communication with one another, such as shown in FIGS. 1-3. Each of the top five sorting trays 12*a-e* is configured to receive and selectively transmit or dispense a subset of the selected products according to the products' size and/or shape. For example, the top-most sorting tray 12*a* receives a mixed collection of products from the user, such as from a collection bin located at a retail sales counter or point-of-sale, and selectively transmits or dispenses a large subset of the products to a first successive (second overall) sorting tray 12*b*, which then selectively transmits or dispenses a further reduced subset of the products to a second successive (third overall) sorting tray 12*c*. Thus, each successive sorting tray will receive and selectively dispense products to lower sorting trays, assuming that at least some of the products in the initial group of products are sufficiently small and appropriately shaped to pass through the openings or apertures or slots formed in each tray 12*a-e*. In the illustrated embodiment, the bottom-most (sixth overall) tray 12*f* is configured as a bin that receives and retains any subset of products that is dispensed from the second-to-last (fifth overall) tray 12*e*. The bottom-most tray 12*f* will only receive products that have passed through each of the other sorting trays 12*a-e*, such that the products in the lowest tray 12*f* are typically the smallest overall products or those products having the smallest length, width, or height compared to the length, width, or height of the other products.

Figure 12:
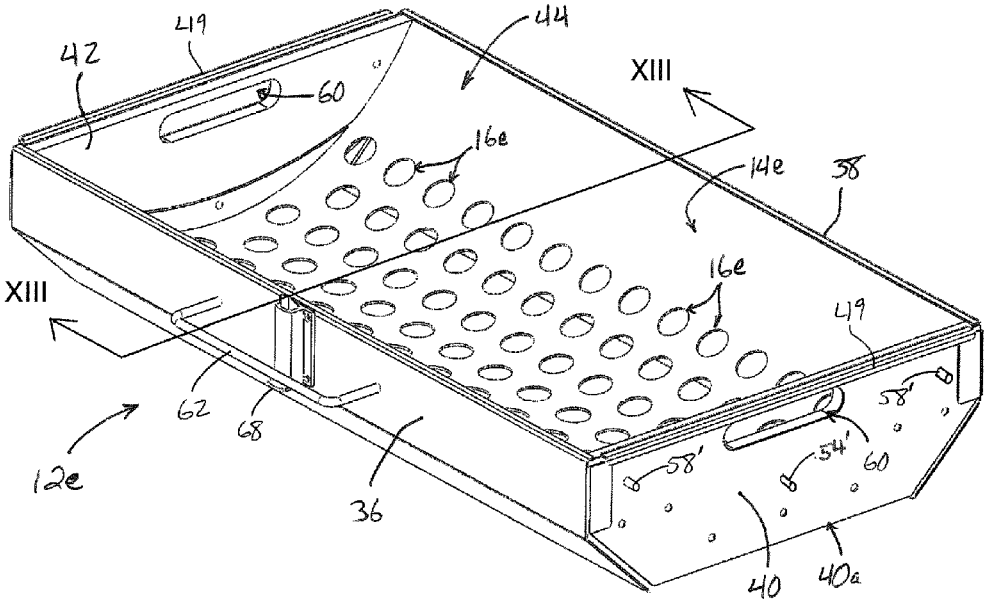
FIG. 12 is a top perspective view of a sorting tray with circular apertures formed along a concave bottom panel.
Figure 13:
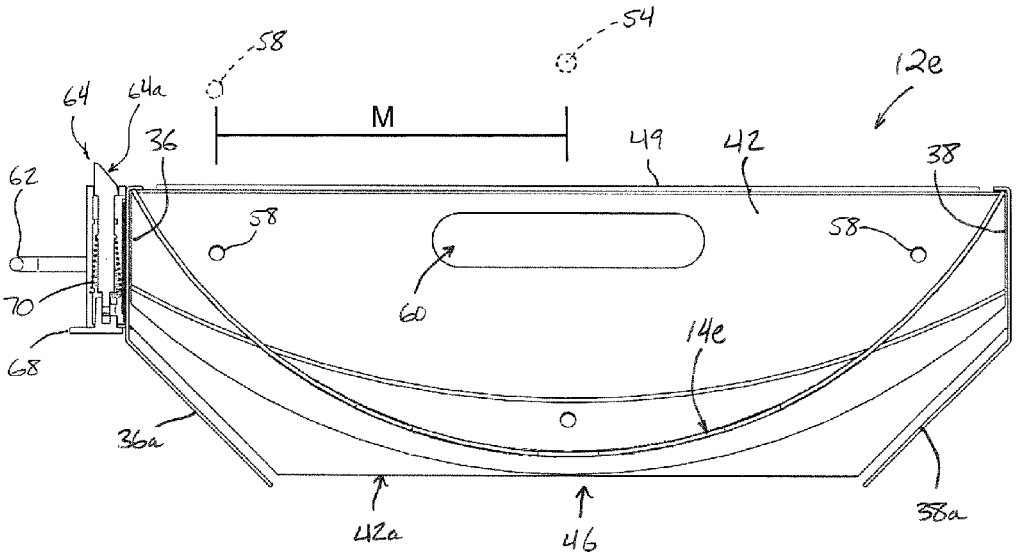
FIG. 13 is a left side sectional elevation taken along line XIII-XIII in FIG. 12.
Figure 14:
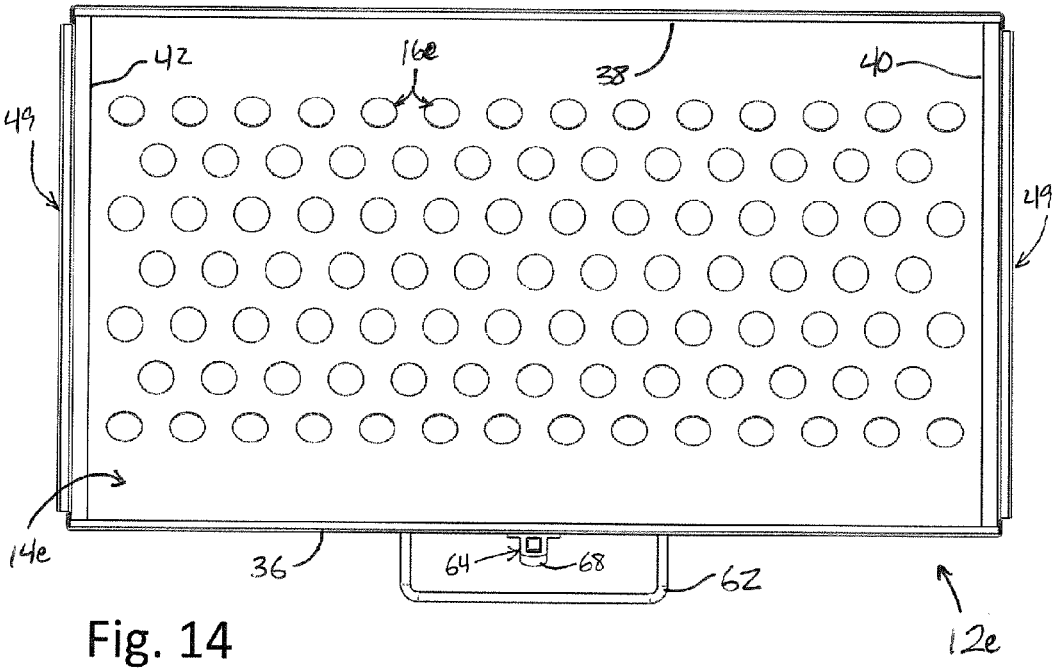
FIG. 14 is top plan view of the sorting tray of FIG. 12.
Figure 15:
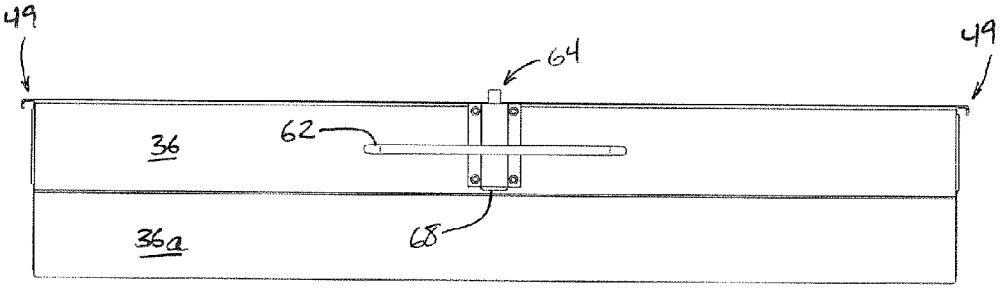
FIG. 15 is a front elevation of the sorting tray of FIG. 12.
Figure 16:
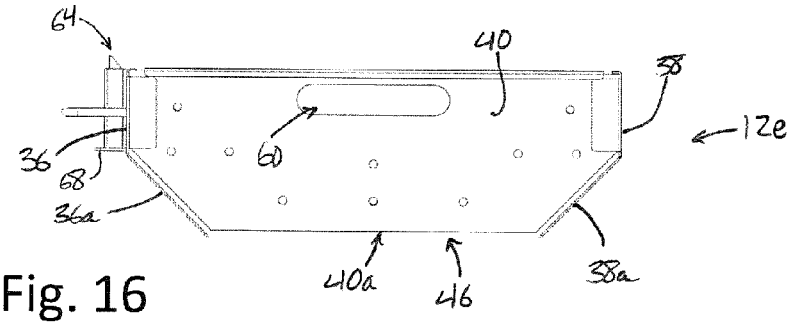
FIG. 16 is a left side elevation of the sorting tray of FIG. 12.

Sorting trays 12*a-f* may have substantially the same outer shape as one another so as to readily fit together in a closely stacked and/or partially nested arrangement. In the illustrated embodiment, each of the sorting trays 12*a-f* has a rectangular outer shape. However, it will be appreciated that the sorting trays 12 may have other shapes, such as polygonal, circular or elliptical. Referring to FIGS. 12-14, the fifth tray 12*e* (which is substantially representative of the other sorting trays 12*a-c*) has its bottom sorting panel 14*e* surrounded along its rectangular perimeter by a front wall 36, a rear wall 38, a left sidewall 40, and a right sidewall 42, which cooperate to define an upper open or input region 44. As best shown in FIGS. 12, 13 and 16, front wall 36 and rear wall 38 each includes a respective lower inwardly-sloped panel or portion 36*a*, 38*a*, which cooperate with respective lower ends 40*a*, 42*a* of left and right sidewalls 40, 42 to define a lower open or output region 46 of tray 12*e*. Products positioned loosely atop bottom sorting panel 14*e* are biased toward the lower output region 46 by gravity as the tray rocks or oscillates, and the products passing through openings 16 may be guided into the next lower tray by the inwardly-sloped lower panels 36*a*, 38*a* of the front and rear walls 36, 38. Products that remain in the tray 12*e* are retained along the bottom sorting panel 14*e* by the front and rear walls 36, 38 and the sidewalls 40, 42.

Bottom sorting panel 14*e* is concave-up and disposed between the upper open region 44 and the lower output region 46, and has a plurality of apertures 16*e* with a selected size, shape, and arrangement along the panel 14*e* to allow only certain products having a certain range of sizes and/or shapes to pass though apertures 16 when the products are set into a substantially random motion along the panel 14*e* by the sorter's motor 26. In the illustrated embodiment, sorting panel 14*e* has the largest number of apertures 16, which are of the smallest size, of all the sorting trays 12*a*, 12*b*, 12*c*, 12*e* having a similar configuration as one another. However, the top-most sorting tray 12*a* has a sorting panel 14*a* with a fewer number of relatively large apertures 16*a*, each having a large circular shape, which allow passage of a large subset of products to the output 46 (i.e., most types of products will fall through the larger apertures 16*a*), if the products have a smaller relative size or a sufficiently small cross-sectional shape compared to the apertures 16*a*. However, products that are larger than the large circular shape of the largest apertures 16*a* will be prevented from passing to the corresponding output 46 of the top-most sorting tray 12*a*.

The number of apertures, their sizes, shapes, and positions along the respective sorting panels 14*a*, 14*b*, 14*c*, 14*e*, are selected to achieve acceptable levels of efficiency for allowing desired products to pass through the apertures to the next tray while retaining a desired subset of products in each sorting tray and minimizing the number of products retained in a given tray, after a given cycle time, that were intended to pass through that tray. Typically, each successive tray will have smaller apertures than the tray located directly above, although different tray configurations may be used to sort out specific types of products that are not as readily sorted using holes or apertures formed in concave-up sorting panels, one example of which (sorting tray 12*d*) will be described in more detail below. Thus, sorter 10 can utilize different trays and apertures to sort the products according to shape and/or size. Although a six-tray embodiment of product sorter 10 is shown and described herein, it will be appreciated that substantially any number of trays (typically two or more) may be used, without departing from the spirit and scope of the present invention.

Optionally, indicia may be placed along each sorting tray 12*a-f* that is indicative of acceptable vertical arrangements of the trays, such as to provide a clear visual indication that a selected tray should only be positioned below certain other trays, or vice versa. For example, sorting trays having larger openings or apertures may be assigned lower numbers while sorting trays having smaller openings or apertures may be assigned progressively higher numbers, so that a user observing a lowest-numbered tray at the top and progressively higher numbers on trays below, can quickly ascertain that the trays are in an acceptable order.

In the illustrated embodiment, the sorting panels 14*a*, 14*b*, 14*c*, 14*e* are curved to facilitate sorting of the products by sliding them along top surfaces of the panels during rocking or oscillating motion of the trays 12*a*, 12*b*, 12*c*, 12*e*. The panels 14*a*, 14*b*, 14*c*, 14*e* are curved about a longitudinal axis that is generally parallel to the trays' front and rear walls 36, 38 and generally perpendicular to left and right sidewalls 40, 42. The curvature of the sorting panels 14*a*, 14*b*, 14*c*, 14*e* may correspond to radial distance to mounting pins that define a given tray's pivot axis. Optionally, the sorting panels may have a curvature with a different radius than the distance from the panel to the pivot axis, which may increase the level of tumbling or agitation to the products as the trays oscillate. It will further be appreciated that the sorting panels may be partially or entirely planar, and oriented to be parallel to a given sorting tray's open top, or may be set on a diagonal, without departing from the spirit and scope of the present invention.

Figure 7:
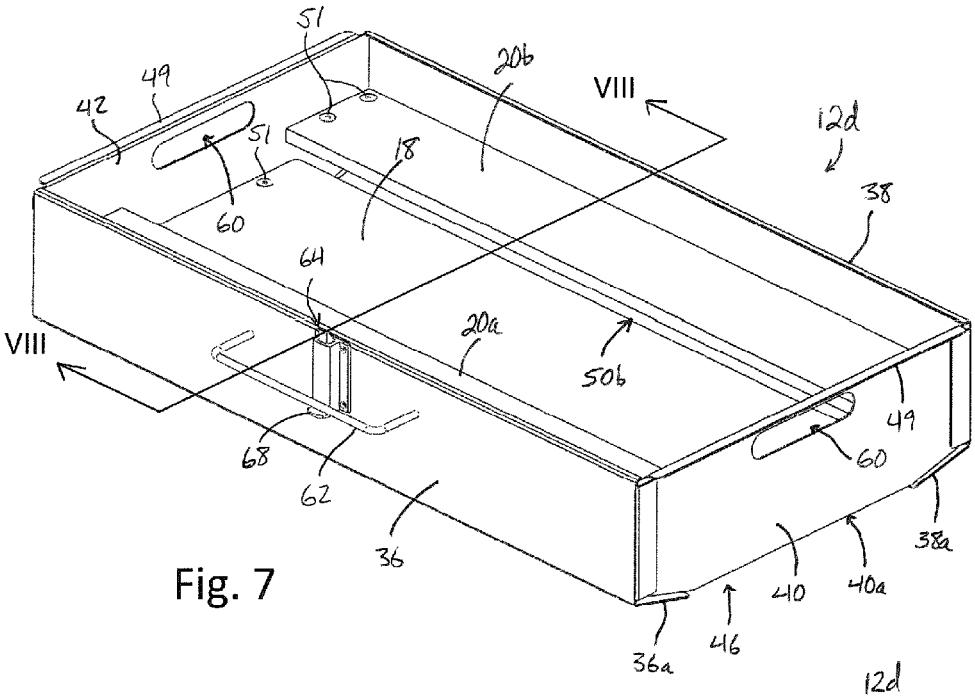
FIG. 7 is a top perspective view of a sorting tray with slot apertures formed between planar bottom panels.
Figure 8:
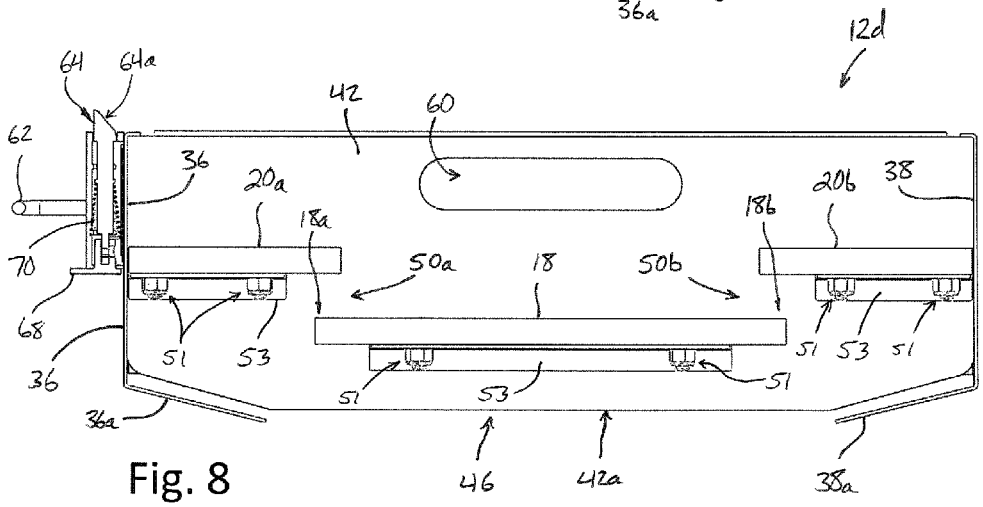
FIG. 8 is a left side sectional elevation taken along line VIII-VIII in FIG. 7.
Figure 9:
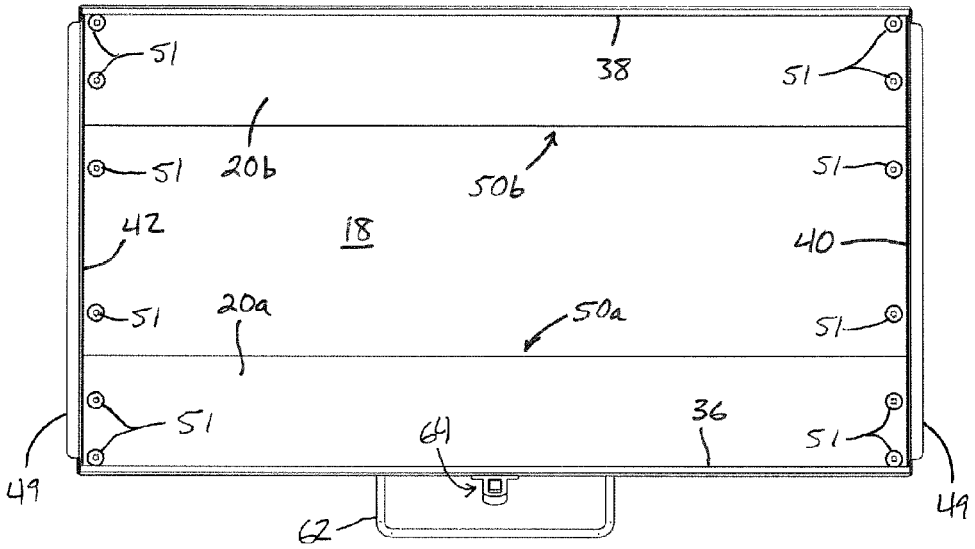
FIG. 9 is a top plan view of the sorting tray of FIG. 7.
Figure 10:
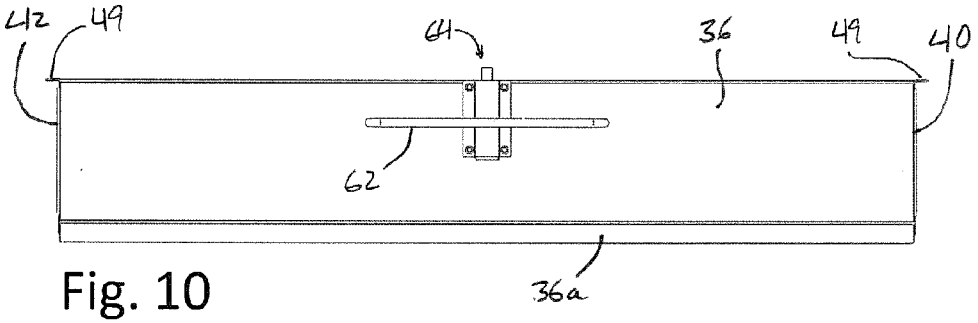
FIG. 10 is a front elevation of the sorting tray of FIG. 7.
Figure 11:
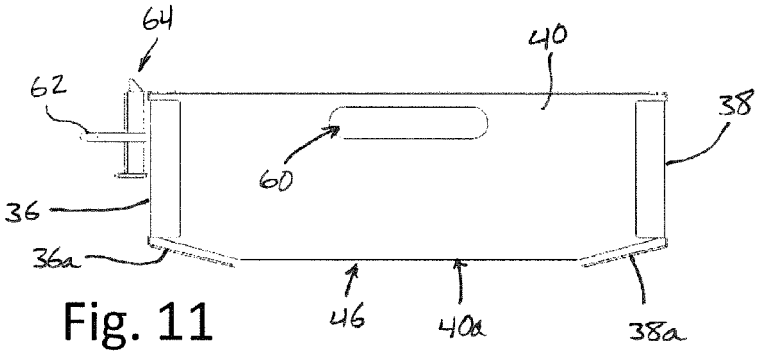
FIG. 11 is a left side elevation of the sorting tray of FIG. 7.

Some products to be sorted may have shapes and/or sizes that are more readily sorted with elongate slots than with spaced-apart openings or apertures formed in a sorting panel. Referring to FIGS. 7-11, sorting tray 12*d* has a different sorting configuration or mechanism than the other sorting trays 12*a*, 12*b*, 12*c*, 12*e*. Sorting tray 12*d* has a forward slot 50*a* that is defined between a front edge region 18*a* of planar bottom panel 18 and an inboard edge region of front elevated panel 20*a*, such as shown in FIGS. 8 and 9. Similarly, a rearward slot 50*b* is defined between a rear edge region 18*b* of planar bottom panel 18 and an inboard edge region of rear elevated panel 20*b* (FIGS. 7-9). The height of each slot 50*a*, 50*b* is adjustable according to the widths selected for bottom panel 18 and elevated panels 20*a*, 20*b*, which are removable and replaceable using fasteners 51 that couple the panels to respective support flanges 53 along inboard surfaces of sidewalls 40, 42 (FIG. 8).

The rocking or oscillating motion causes the products to move along the planar bottom panel 18 toward slots 50*a*, 50*b*, where some of the products impact the inboard edges of elevated panels 20*a*, 20*b* and others pass through the slots. Thus, slots 50*a*, 50*b* allow passage of the subset of products to the lower output region 46, if the products have a smaller relative size compared to the height of the slots. Products that too large to pass through the slots 50*a*, 50*b* will be prevented from passing to the lower output region 46. Moreover, products that tend to lie flat and have lateral dimensions that make them less likely to pass through apertures 16 in a curved sorting panel, may pass more readily through slots 50*a*, 50*b* than in apertures 16.

Products that reach a given output 46 of a given tray 12*a-e* are passed to successive trays, some of which have sorting panels 14*b*, 14*c*, *d*, 14*e* with successively smaller apertures 16 or smaller slots 50*a*, 50*b*. The sorter and individual sorting trays of the present invention may be suitable for sorting many different types of products such as securing tags ranging from "puck" tags, HAWKEYE tags, "screamer" (noise-making) tags, ink tags, MICRO GATOR tags, ULTRA MAX tags, "pin" and "pencil" tags. However, it will be appreciated that many other types of products may be sorted using the sorter and methods of the present invention.

Figure 19:
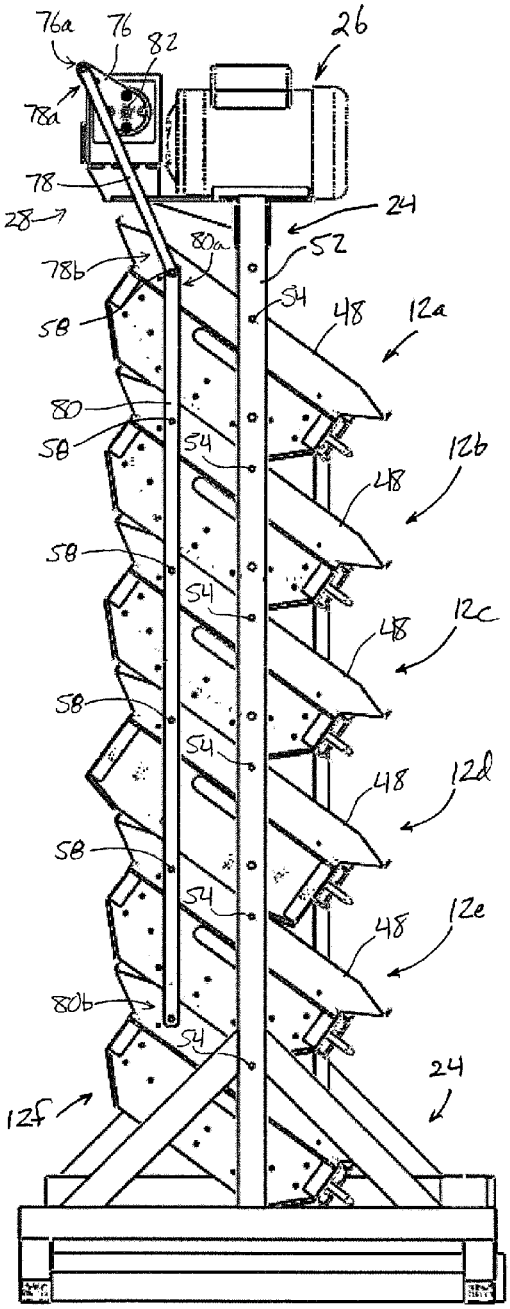
FIG. 19 is a right side elevation of the product sorter of FIG. 1 with its door, safety cage, and outer support frame removed, and with its drive mechanism and sorting trays in a forward-tilted position.
Figure 20:
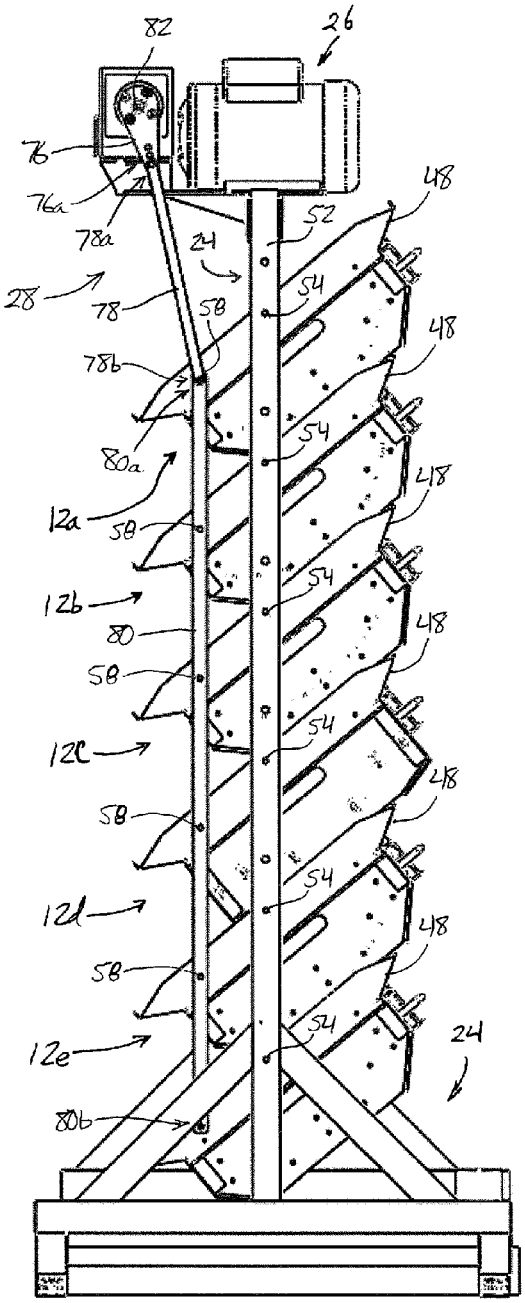
FIG. 20 is another right side elevation of the product sorter of FIG. 19, with its drive mechanism and sorting trays in a rearward-tilted position.

Sorting trays 12*a-f* are readily mountable to respective tray mounts 48 (FIGS. 1-3, 5, and 17A-20) that, in turn, are pivotably mounted between a pair of uprights 52 of structural frame 24. Each tray mount 48 has a pair of mounting pins or bushings 54, one of which is located above each of the tray's sidewalls 40, 42 when the tray is mounted to the tray mount 48 in a manner that will be more fully described below. The mounting pins or bushings 54 extend outboard to engage a respective opening or generally U-shaped receiving member or spindle at a respective upright 52 of structural frame 24, such as shown in FIGS. 2, 19 and 20. Thus, mounting pins or bushings 54 define pivot axes for each tray 12*a-f* and tray mount 48, and may further be used to couple the tray mounts 48 permanently or substantially permanently to structural frame 24.

Figure 17A:
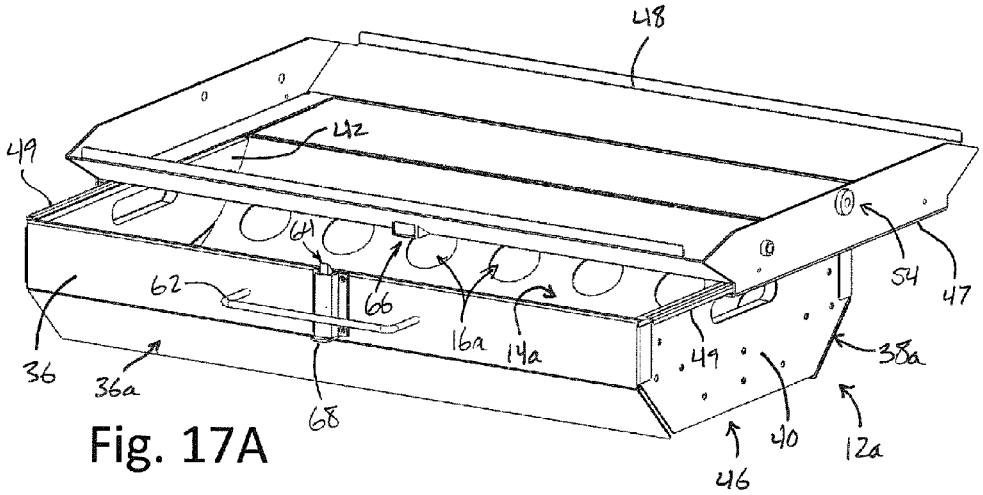
FIGS. 17A and 17B are perspective views of another sorting tray shown partially and fully engaged, respectively, with a tray mount.
Figure 17B:
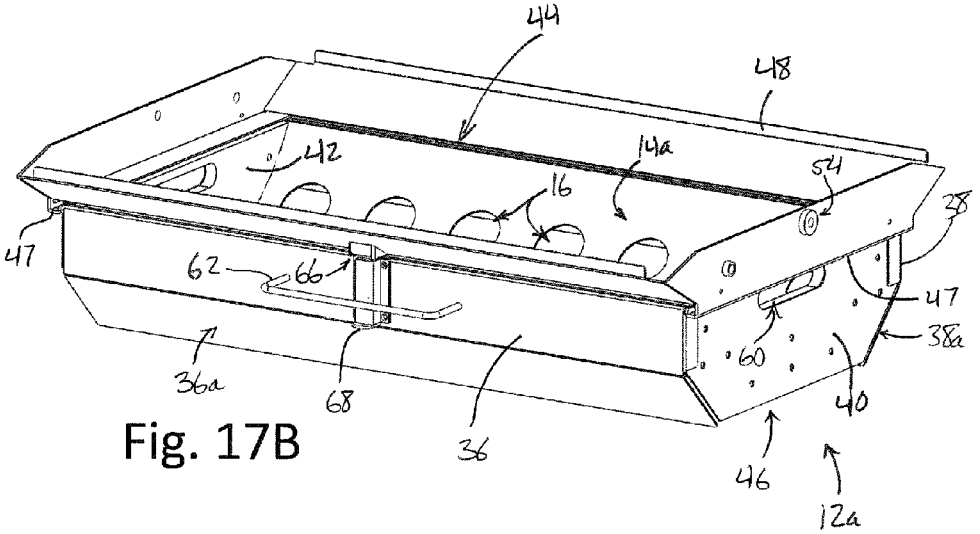

Tray mounts 48 extend upwardly and laterally outwardly relative to each of the front and rear walls 36, 38, and extend at least upwardly above the sidewalls 40, 42, and may perform a funneling or channeling function to facilitate directing all products that pass through a given tray into the upper open region 44 of the next lower tray. Each tray mount 48 has an inwardly-directed support flange or ledge 47 at the bottom of each side, such as shown in FIGS. 17A and 17B, for receiving an outwardly-directed flange or ledge 49 at an upper end 40*b*, 42*b* of each sorting tray's sidewall 40, 42. The outwardly-directed flanges 49 of sidewalls 40, 42 engage and slide along top surfaces of the inwardly-directed support flanges 47 of tray mount 48, so that the weight of each sorting tray 12*a-f* is supported by the tray mount's inwardly-directed support flanges 47 (FIGS. 17A-18B). Optionally, the tray mounts 48 and sorting trays 12*a-f* may be keyed so that only one type of sorting tray can be mounted at a specific tray mount, thereby preventing a sorting tray with the smallest openings from being placed in the top-most tray mount, for example. As will be described in more detail below, the sorting trays 12*a-f* are releasably securable to respective tray mounts 48 to ensure that the trays remain securely mounted during sorting operations.

Sorting trays 12*a-f* are readily removable from tray mounts 48, such as to facilitate removal of sorted products or to change the types of products that will be sorted or filtered out at each level of the sorter. When the trays 12*a-f* mounted to their tray mounts 48 and are in a level or horizontal orientation (FIGS. 1-5), pins or bushings 54 are located at a higher elevation than the corresponding front and rear walls 36, 38 and sidewalls 40, 42. However, during operation of sorter 10, the upper edges of front and rear walls 36, 38 are alternately at higher and lower vertical elevations than the corresponding mounting pins or bushings 54, such as shown in FIGS. 19 and 20. Moreover, the upper edges of front and rear walls 36, 38 of a given sorting tray 12*a-f* are alternately at a higher elevation than the inwardly-sloped lower panels 38*a*, 36*a* of the rear and front walls 38, 36 of the sorting tray located immediately above. When sorting trays 12*a-f* are near their ends-of-travel (FIGS. 19 and 20), the forward and rearward portions of tray mounts 48 are positioned to help direct product from the lower output region 46 of the next-higher sorting tray into the receiving tray's open upper input region 44, thus providing a funneling function.

Figure 18A:
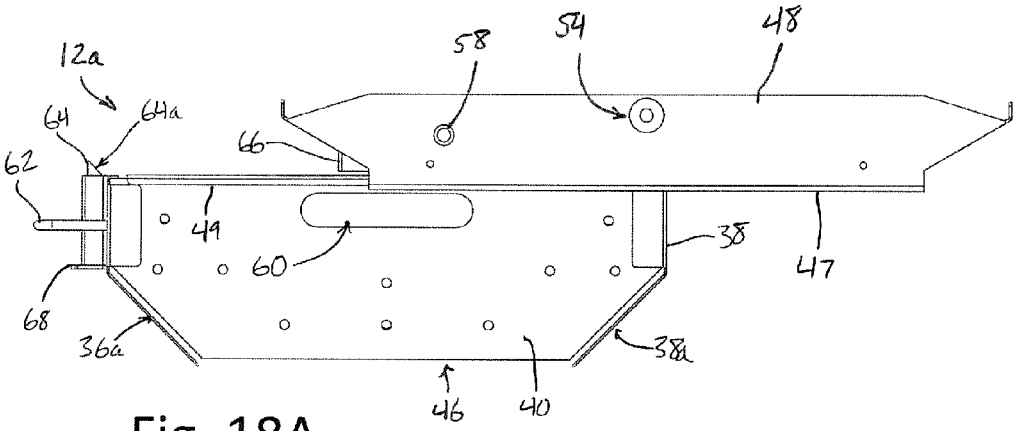
FIGS. 18A and 18B are left side elevations of the sorting tray and tray mount corresponding to FIGS. 17A and 17B, respectively.
Figure 18B:
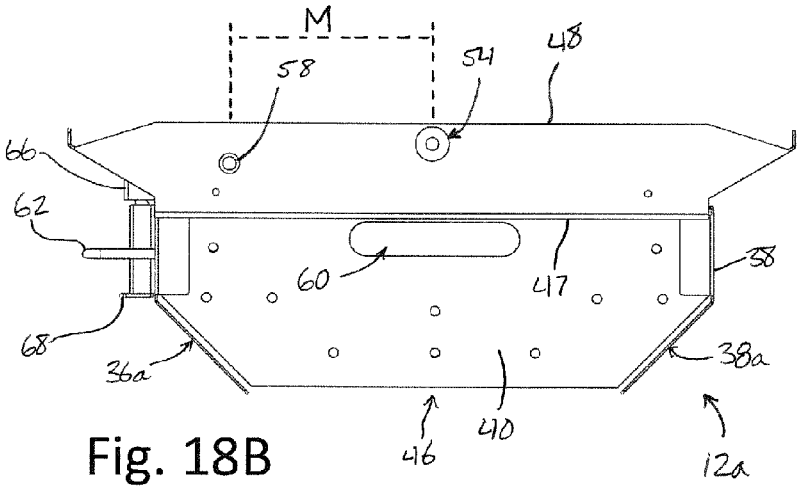

Each of the tray mounts 48 has a connection point or pin 58 spaced laterally from the mounting pin or bushing 54, such as shown in FIGS. 17A-18B. On each sorting tray 12*a-f*, the horizontal distance between each connection point or pin 58 and the mounting pin or bushing 54 provides a moment arm M, such as shown in FIGS. 13 and 18B. Thus, the sorting trays 12*a-f* will rock or oscillate in a synchronized and symmetrical fashion, with the rear walls 38 rising simultaneously to a first position (FIG. 19) that is the same height that the front walls 36 rise when in a second position (FIG. 20). Optionally, the sorting trays 12*a-f* may have mounting pins 54' and connection pins 58' positioned along sidewalls 40, 42, such as shown in FIG. 12. It is further envisioned that the mounting pins could be located in other locations that are spaced laterally away from central axes of the sorting trays, in which case the sorting trays can be made to rock or oscillate differently from one another, or to rise more in a first position than in a second position (asymmetrically).

To facilitate manual handling and moving the sorting trays, and installing and removing the sorting trays 12*a-f* at structural frame 24, each tray is optionally provided with a slot 60 formed or established in an upper region of each of left sidewall 40 and right sidewall 42. Slots 60 are sufficiently large to be engaged by a user's fingers when a given sorting tray is individually being moved from one location to another. In addition, a gripping handle 62 is provided at each front wall 36 to facilitate sliding each sorting tray 12*a-f* into and out of its respective tray mount 48, such as shown in FIGS. 17A-18B. A spring-biased locking pin 64, best shown in FIGS. 8 and 13, is also mounted to front walls 36, and engages a receiving portion 66 formed at tray mount 48 directly above locking pin 64 when the sorting tray is fully engaged with its respective tray mount 48. A manual release tab 68 is located at a lower end of locking pin 64, and can be manually depressed (against the biasing force of a spring 70, FIGS. 8 and 13) to disengage the upper tip of locking pin 64 from the receiving portion 66 in tray mount 48, thus allowing the sorting tray to be slid out from its tray mount. Spring 70 automatically biases locking pin 64 into the receiving portion 66 in tray mount, after the pin 64 is initially urged downwardly due to sliding engagement of a sloped upper surface 64*a* of the pin with receiving portion 66, once the sorting tray 12*a-f* is fully engaged with its tray mount 48 (FIGS. 17B and 18B).

Structural frame 24 supports motor 26 at an upper cross-member 74 that is coupled between the pair of uprights 52, and the uprights 52 further support the sorting trays 12*a-f*, controller 30, outer support frame 34, and safety cage or screen 32. The structural frame 24 and outer support frame 34 are generally fabricated of metal, such as square metal tubing that is welded or fastened. However, the frames 24, 34 may be fabricated from many materials, such as resinous plastic, wood, fiber-reinforced plastic, or the like. Furthermore, the structural frame 24 may be secured to a floor or other support surface using fasteners to prevent tipping or falling, although it is envisioned that the sorter 10 could also be mounted on caster wheels, preferably lockable caster wheels, to facilitate moving the sorter to different areas of a facility.

Motor 26 is mounted to upper cross-member 74 above the sorting trays 12*a-f*. The linkage 28 includes an output arm 76, a drive link 78, and a connecting link 80, such as shown in FIGS. 2, 19 and 20. In the illustrated embodiment, the output arm 76 is fastened to an output shaft 82 of the motor 26 so that a distal end 76*a* of the output arm 76 traces a circular path. The drive link 78 has a first or upper end 78*a* connected to the distal end 76*a* of the arm 76 and a second or lower end 78*b* connected to an upper end 80*a* of the connecting link 80. The connecting link 30 is connected to each of the tray mounts 48 at their respective connection pins 58. In the illustrated embodiment, the connecting link 30 is coupled to the connection pins 58 that are located toward the rear of each tray mount 48, although it will be appreciated that the orientation of the motor 26 could be reversed and the connecting link 30 coupled to the connection pins 58 at the front of each tray mount 48. Optionally, the connection pins 58 that are not engaged by the connecting link 30 can instead be engaged by a non-driven stabilizing link.

The rocking or oscillating motion of the plurality of sorting trays 12*a-f* may have varied rocking amplitude and rocking period, as determined by the moment arm M (as determined by the lateral or horizontal distance between connection pins 58 and mounting pins or bushings 54), the length of the output arm 26, length of the drive link 28, and motor speed. However, it will be appreciated that many different configurations or arrangements are possible, without departing from the spirit and scope of the present invention. For example, the drive motor 26 could be mounted below or adjacent the sorting trays 12*a-f*, and the drive link 28 could couple to one connection pin 58 (such as at the top-most tray mount 48) while a connecting link couples the sorting trays together at the connection pins 58 on an opposite side from drive link 28. It will further be appreciated that connecting link 30 could be driven in a reciprocal manner by a pneumatic or hydraulic piston-cylinder arrangement, jackscrew, or other linear actuator, a gear train, chain-and-sprocket arrangement, cam-and-follower arrangement, one or more motors (e.g. servo motors) or rotary actuators that can rotatably drive mounting pins 54, or substantially any type of powered driver capable of generating sufficient force in a rotary or reciprocating manner. It is further envisioned that a hand-operated or foot-operated lever or crank could be readily substituted for the various powered drive mechanisms described above, such as to provide a lower-cost product sorter that has lower weight and does not require a connection to an energy source such as an electrical supply or a source of pressurized air or hydraulic fluid.

Connecting link 80 imparts and constrains the motion of each sorting tray to match that of the other trays so that all trays move in a synchronized manner. In the illustrated embodiment, the connecting link 80 is straight between its upper end 80*a* and a lower end 80*b*, and each of the sorting trays 12*a-f* has a connection point 58 that is substantially evenly spaced along the connecting link 80. However, it will be appreciated that the synchronicity of the rocking or oscillating motion may vary by changing the moment arm M, distances between connection points 58, or by using separate actuators for one or more trays.

When product sorter 10 is set up for use, its mechanisms and moving parts are preferably substantially fully enclosed in safety cage 32 that includes two side panels 32*a*, 32*b*, a back panel 32*c* (FIG. 1) and also a door (not shown) that is coupled to hinges 84 at side panel 32*b* and a latch 86 at side panel 32*a* (FIGS. 1-6) when the door is closed. Safety cage 32 is configured to prevent a user from touching or affecting the moving parts of sorter 10 during its operation. The safety cage 32 and other built-in safety sensors or devices in communication with controller 30 reduce the likelihood of personnel injury or mechanical damage to the sorter by limiting or preventing access to the moving parts of the sorter during its operation, and by de-energizing the motor 26 if any one or more sensors detect an unsafe condition, such as an open access door or a sorter tray 12*a-f* that is not fully seated and latched in its tray mount 48.

For example, the controller 30 (or associated electrical circuit) may have an open state that changes to a closed state when one or more sensors or other safety devices detect that sorter 10 is ready for operation, including closure of a door at the front of the safety cage 32. Controller 30 may be configured to permit sorter 10 to operate only when the controller 30 is enabled and any safety devices or sensors are closed (i.e., not triggered). If the user or a bystander triggers one or more safety devices or sensors, the safety device or sensor will revert to the open state and the controller 30 will de-energize (or prevent energizing) motor 26. Safety devices or sensors may include, for example, a light curtain that detects when it has been intersected by a person or other foreign object, or a circuit breaker or other electrical device that detects when motor 26 is drawing more than a threshold maximum current, since a high current draw could be indicative of an electrical short or binding in the drive system, or of a foreign object in the mechanism. The controller 30 may further include a reset button or switch to reset the safety device to the closed state and enable the controller 30 when the sorter 10 is determined to be safe to operate after triggering the safety device, particularly if the safety device does not automatically reset itself. However, the sorter 10 may also operate in a test mode, wherein the safety device is in a closed or override state regardless of the door position or state of any other safety devices. Other types of common safety devices may be used with the sorter 10, such as an emergency kill switch or a safety switch mat.

Controller 30 is configured to operate the motor 26 in at least one operating mode. Controller 30 has a user interface 72 (FIGS. 1, 3, and 6) that receives at least one input parameter from a user. The controller 30 is in electrical communication with the motor 26, to transmit operating commands to the motor 26 based on the input parameters. The operating commands may be as simple as on/off (e.g., a simple power switch), a start button that initiates a pre-programmed cycle (e.g., a predetermined operating speed over a predetermined length of time), after which controller 30 de-energizes the motor 26, or a programming interface that permits a user to select an operating speed and/or operating time for a desired cycle. In the time-based mode, the input parameter is an operating time for the sorter 10 to energize drive mechanism 14 and sort the products, after which the sorter 10 will automatically turn off the drive mechanism. In the time-based mode the user may input the operating time on user interface 72, which may be a timer or dial, such as a piezoelectric dial, or in an alternative embodiment, on a numerical key pad or the like. The controller 30 receives the operating time and transmits the operating command (e.g. energizes a circuit) to start the motor 26, and to stop the motor 26 once the selected operating time has elapsed.

In an alternative embodiment, the operating mode may be manually controlled. In a manual operating mode, the user inputs a parameter to turn on the sorter 10, for example by a switch on the controller 30. The controller 30 transmits a command (which may involve simply energizing an electrical circuit) to operate the motor 26. The sorter 10 will then operate to sort the products and the user may observe the sorting trays to determine that the desired sortation is underway. During this observation period, the user may determine, for example, that a given tray was placed in an undesirable location, such as a tray with very small apertures or slots placed above a tray with larger apertures or slots. The user may cancel the cycle or place the cycle on hold, and make any appropriate adjustments before restarting a sorting operation. When the user is satisfied that the products are sufficiently sorted, the user inputs a parameter to turn off the motor 26, wherein the controller 30 sends a command to the motor 26 to turn off (such as by de-energizing the circuit).

The controller 30 may be capable of signal-based operating modes, such as a time-based mode in which the controller automatically de-energizes the motor after a predetermined amount of time has elapsed, to obviate the need for a user to manually turn off the sorter. It is further envisioned that sensors, such as optical sensors or weight sensors in communication with the controller 30, could be installed at or near the individual sorter trays 12*a-f* or tray mounts 48 to detect products as they fall from one sorting tray to another. When the sensors detect that no products in the sorter have dropped from one sorting tray to another sorting tray over a predetermined length of elapsed time, the controller 30 de-energizes the motor 26. For example, controller 30 could be programmed to de-energize the motor 26 when thirty seconds (or other desired time) elapse without a single product being detected by the sensors, since at that point the sorting may be considered substantially complete.

Optionally, controller 30 may permit other input parameters, such as rocking or oscillating amplitude and frequency to control the intensity at which the plurality of sorting trays 12*a-f* the rocking or oscillating motion. For example, a user may determine that the sorting trays 12*a-f* can rock or oscillate more quickly for a given group of products without unintentional discharging or spilling of the products, so that the products can be sorted quickly. The rocking or oscillating amplitude parameter may be manually set by the length of moment arm M or output arm 76, or if a variable-displacement linear actuator is used, the amplitude may be selectable using a further user input for controlling the actuator's displacement distance.

Thus, it will be appreciated that the product sorting apparatus is operable to efficiently sort products having many different shapes and sizes, and is relatively compact and easy to use. The product sorting apparatus sorts products by imparting an oscillating or rocking motion to a plurality of sorting trays in a stacked arrangement, each tray having its own unique arrangement of apertures configured to permit only a subset of products to pass therethrough. The sorting apparatus reduces manual labor required for sorting, and can improve safety by reducing the need for manual handling of the products, particularly for products that have sharp points or edges, pinch points, or the like. Optionally, the sorter can be operated in automatic or semi-automatic modes, and its sorting trays are removable for use in transporting sorted products to other locations.

Changes and modifications in the specifically described embodiments can be carried out without departing from the principles of the present invention which is intended to be limited only by the scope of the appended claims, as interpreted according to the principles of patent law including the doctrine of equivalents.

The embodiments of the invention in which an exclusive property or privilege is claimed are defined as follows:

1. A product sorter comprising:

a frame;

a drive mechanism coupled to said frame;

a plurality of sorting trays, each of said sorting trays including a product separator and defining an open upper input region above said product separator and an open lower output region below said product separator, wherein said sorting trays are movably coupled to said frame in a vertically stacked arrangement and are operatively coupled to said drive mechanism;

a first tray mount and a second tray mount, said first and second tray mounts pivotably coupled to said frame with said first tray mount positioned above said second tray mount, wherein a first of said sorting trays is releasably coupled to said first tray mount and a second of said sorting trays is releasably coupled to said second tray mount;

a connecting link coupled to each of said first and second tray mounts and extending between said first and second sorting trays, wherein said connecting link is configured to synchronize oscillating movement of said first and second sorting trays;

said product separator defining an opening that is sized and shaped to permit passage of at least one type of product in a group of products comprising multiple product types; and wherein said drive mechanism is operable to oscillate said sorting trays to thereby move the products along said product separators in response to actuation of said drive mechanism.

2. The product sorter of claim 1, wherein said drive mechanism comprises a motor and a drive link coupled between said motor and a first of said sorting trays.

3. The product sorter of claim 2, further comprising a controller operable to selectively energize and de-energize said motor, wherein said controller comprises a user interface configured to receive at least one input parameter from a user.

4. The product sorter of claim 3, wherein said controller comprises a timer and is operable to de-energize said motor after a predetermined amount of time.

5. The product sorter of claim 1, wherein said tray mounts are generally funnel-shaped and are configured to direct the products into said open upper input regions of said sorting trays.

6. The product sorter of claim 1, wherein said product separator of said first sorting tray comprises a concave-up sheet defining a plurality of said openings in spaced arrangement.

7. The product sorter of claim 6, wherein said product separator of said second sorting tray comprises a bottom central panel and at least one elevated panel that is both laterally offset and vertically offset from said bottom central panel to thereby define an elongate slot between an outboard edge of said bottom central panel and an inboard edge of said elevated panel.

8. The product sorter of claim 7, further comprising a third of said sorting trays having a product separator comprising a concave-up sheet defining a plurality of said openings in spaced arrangement, wherein said openings of said third sorting tray are smaller than said openings of said first sorting tray, and wherein said second sorting tray is positioned directly below said first sorting tray and directly above said third sorting tray.

9. The product sorter of claim 8, wherein said sorting trays are configured to pivot in a rocking manner in response to actuation of said drive mechanism, and wherein said sorting trays are vertically spaced apart from one another and are configured so that when said sorting trays are in a first position, said second sorting tray is entirely below said first sorting tray and said third sorting tray is entirely below said first and second sorting trays, and when said trays are in a second position that is pivoted away from said first position, at least a portion of said second tray is located above at least a portion of said first sorting tray and at least a portion of said third sorting tray is located above at least a portion of said second sorting tray.

10. The product sorter of claim 9, further comprising a third tray mount pivotably coupled to said frame, wherein said first tray mount is positioned above said second tray mount and said second tray mount is positioned above said third tray mount, wherein said third sorting tray is releasably coupled to said third tray mount.

11. The product sorter of claim 1, wherein said sorting trays are configured to pivot in a rocking manner in response to actuation of said drive mechanism.

12. The product sorter of claim 11, wherein said second sorting tray is positioned directly below said first sorting tray, and wherein said first and second sorting trays are configured so that when said trays are in a first position, said second sorting tray is entirely below said first sorting tray, and when said first and second sorting trays are in a second position that is pivoted away from said first position, at least a portion of said second sorting tray is located above at least a portion of said first sorting tray.

13. A product sorter comprising:

a frame having a pair of spaced-apart uprights;

a powered drive mechanism supported at said frame; and a plurality of open-top sorting trays in a substantially vertical arrangement in which said sorting trays are pivotably coupled to and span between said uprights, each of said sorting trays configured to dispense or receive products to or from at least one other of said sorting trays, wherein at least one of said sorting trays comprises a separator panel defining one or more openings configured to selectively transmit at least a subset of the products therethrough;

wherein said separator panel of at least one of said sorting trays comprises a bottom central panel and at least one elevated panel that is both laterally offset and vertically offset from said bottom central panel to thereby define an elongate slot between an outboard edge of said bottom central panel and an inboard edge of said elevated panel.

14. The product sorter of claim 13, further comprising a connecting link coupled between a first of said sorting trays and a second of said sorting trays, wherein said connecting link is operable to synchronize oscillating movement of said first and second sorting trays.

15. The product sorter of claim 14, further comprising first and second tray mounts pivotably coupled to said frame with said first tray mount positioned above said second tray mount, wherein said first sorting tray is releasably coupled to said first tray mount and said second sorting tray is releasably coupled to said second tray mount, and said connecting link is coupled to each of said first and second tray mounts.

16. The product sorter of claim 15, wherein said sorting trays comprise respective upper portions configured to slidingly engage respective lower portions of said tray mounts.

17. The product sorter of claim 16, further comprising locking members operable to releasably lock said sorting trays to respective ones of said tray mounts upon full engagement of said sorting trays with said tray mounts.

18. The product sorter of claim 13, wherein said sorting trays comprise first and second sorting trays that are vertically spaced apart from one another and are configured so that when said sorting trays are in a first position, said second sorting tray is entirely below said first sorting tray, and when said sorting trays are in a second position that is pivoted away from said first position, at least a portion of said second tray is located above at least a portion of said first sorting tray.

19. A product sorter comprising:

a frame having a pair of spaced-apart uprights;

a powered drive mechanism supported at said frame;

a plurality of open-top sorting trays in a substantially vertical arrangement in which said sorting trays are pivotably coupled to and span between said uprights, each of said sorting trays configured to dispense or receive products to or from at least one other of said sorting trays, wherein at least one of said sorting trays comprises a separator panel defining one or more openings configured to selectively transmit at least a subset of the products therethrough;

wherein said sorting trays comprise first and second sorting trays that are vertically spaced apart from one another and are configured so that when said first and second sorting trays are in a first position, said second sorting tray is entirely below said first sorting tray, and when said trays are in a second position that is pivoted away from said first position, at least a portion of said second tray is located above at least a portion of said first sorting tray; and a controller configured to operate said powered drive mechanism in at least one operating mode, said controller having a user interface for receiving at least one input parameter from a user;

wherein said powered drive mechanism is mechanically coupled to each of said sorting trays and is operable to oscillate said sorting trays in a rocking manner to thereby cause the products to slide along said separator panels.

20. The product sorter of claim 19, further comprising a plurality of tray mounts pivotably coupled to and spanning between said uprights, wherein said sorting trays are releasably coupled to respective ones of said tray mounts.

* * * * *